US005261219A

United States Patent [19]

Stahlecker et al.

[11] Patent Number: 5,261,219

[45] Date of Patent: Nov. 16, 1993

[54] SPINNING MACHINE WITH A PLURALITY OF SPINNING STATIONS HAVING CONVEYER BELTS WHICH CONVEX SLIVERS

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 881,079

[22] Filed: May 11, 1992

Related U.S. Application Data

[63] Continuation-in-part of Ser. No. 809,143, Dec. 18, 1991, Pat. No. 5,220,776, which is a continuation-in-part of Ser. No. 847,687, Mar. 6, 1992.

[30] Foreign Application Priority Data

May 11, 1991 [DE] Fed. Rep. of Germany ..... 4115459

[51] Int. Cl.[5] ..... D01H 13/04

[52] U.S. Cl. ..... 57/90; 57/315

[58] Field of Search ..... 57/75, 90, 315

[56] References Cited

U.S. PATENT DOCUMENTS 2,896,269 7/1959 Gardella et al. ..... 57/315 X 3,312,050 4/1967 Noguera ..... 57/90

FOREIGN PATENT DOCUMENTS 1179840 10/1964 Fed. Rep. of Germany ..... 57/90

1015780 1/1966 United Kingdom .

*Primary Examiner*—Joseph J. Hail, III

*Attorney, Agent, or Firm*—Evenson, McKeown, Edwards & Lenahan

[57] ABSTRACT

In the case of a spinning machine having a plurality spinning stations to which one depositing site respectively is assigned for a can containing a sliver to be spun, and having transport devices for transporting the slivers from the cans to the spinning stations, it is provided that at least the horizontal sections of conveyor belts pertaining to these transport devices are covered by sliding skids which rest loosely on them and which press the slivers against the conveyor belts.

12 Claims, 2 Drawing Sheets

SPINNING MACHINE WITH A PLURALITY OF SPINNING STATIONS HAVING CONVEYER BELTS WHICH CONVEX SLIVERS

BACKGROUND AND SUMMARY OF THE INVENTION

This invention is a continuation-in-part of my application Ser. No. 07/809,143, filed Dec. 18, 1991 and my application Ser. No. 07/847,687, filed Mar. 6, 1992.

The present invention relates to a spinning machine having a plurality of spinning stations to which depositing sites are assigned for cans containing sliver to be spun, and having transport devices for transporting the slivers from the cans to the spinning stations which comprise conveyor belts with essentially horizontal sections and essentially vertical sections.

In the case of a known spinning machine of the initially mentioned type (British Patent Document 10 15 780), the depositing sites are arranged in several rows in front of the spinning machine. The slivers are withdrawn by means of rollers arranged above the cans and are then guided between pairs of conveyor belts which start between the rows of depositing sites, travel vertically downward from there, then travel below the floor to the center of the ring spinning machine and from there, upwards to the drafting units.

In my above-identified co-pending U.S. applications, it was suggested to provide, for the transport of slivers between cans and the spinning stations, conveyor belts, sliding skids being partly provided which press the slivers with a slight contact pressure against the conveyor belts.

It is an object of the invention to simplify a spinning machine of the initially mentioned type.

This object is achieved in that the conveyor belts are covered, at least in the essentially horizontal sections, by sliding skids which are supported on the conveyor belts and which are provided at their ends with deflecting guides which serve as transitions to the essentially vertical sections.

The sliding skids press the slivers with a slight contact pressure against the conveyor belts so that a secure draft-free conveying takes place without the requirement of providing a plurality of driven and/or rotating elements. In the process, the slivers are rendered smooth and guided well so that the parallel position of the fiber remains ensured. In addition, the sliding skids, by means of their deflecting guides also provide that, also in the area of the transition from the horizontal sections to the vertical sections, the slivers remain on the conveyor belts. By means of this type of a feeding of the slivers from the cans to the spinning stations, it is possible to securely convey and feed also relatively fine slivers, that is, slivers of a size of from Nm 0.3 to Nm 0.8, without the occurrence of drafts in the slivers during the transport.

In a further development of the invention, it is provided that the sliding skids, which are assigned to the essentially horizontal sections of the conveyor belts, are guided on the conveyor belts in the transverse direction. As a result, it is possible to provide very simply constructed sliding skids which align themselves on the conveyor belts.

In a further development of the invention, it is provided that the sliding skids, which are assigned to the essentially horizontal sections of the conveyor belts, are positioned by means of stops in the travelling direction of the conveyor belts. This ensures that particularly the deflecting guide of the sliding skids is arranged at a defined point in relation to the conveyor belts without the requirement of significantly increased expenditures for this purpose.

In a first embodiment of the invention, it is provided that the ends of the sliding skids, which are assigned to the essentially horizontal sections of the conveyor belts, are bent, their bending radius being adapted to the diameter of a deflecting roller which deflects the conveyor belt in this area.

In another embodiment of the invention, it is provided that the ends of the sliding skids assigned to the essentially horizontal sections of the conveyor belts are provided with a deflecting element. These deflecting elements may have a special design, particularly in the shape of condensers.

In a further development of the invention, it is provided that the sliding skids are provided with guiding grooves for the slivers which extend in their longitudinal direction. This ensures that lateral deviations of the slivers from the transport direction are excluded.

In a further development of the invention, introducing elements are provided for introducing the slivers between the conveyor belts and the pertaining sliding skids. This ensures that the slivers enter at defined points between the conveyor belts and the pertaining sliding skids and are conveyed correspondingly.

Other objects, advantages and novel features of the present invention will become apparent from the following detailed description of the invention when considered in conjunction with the accompanying drawings.

DETAILED DESCRIPTION OF THE DRAWINGS

Figure 1:
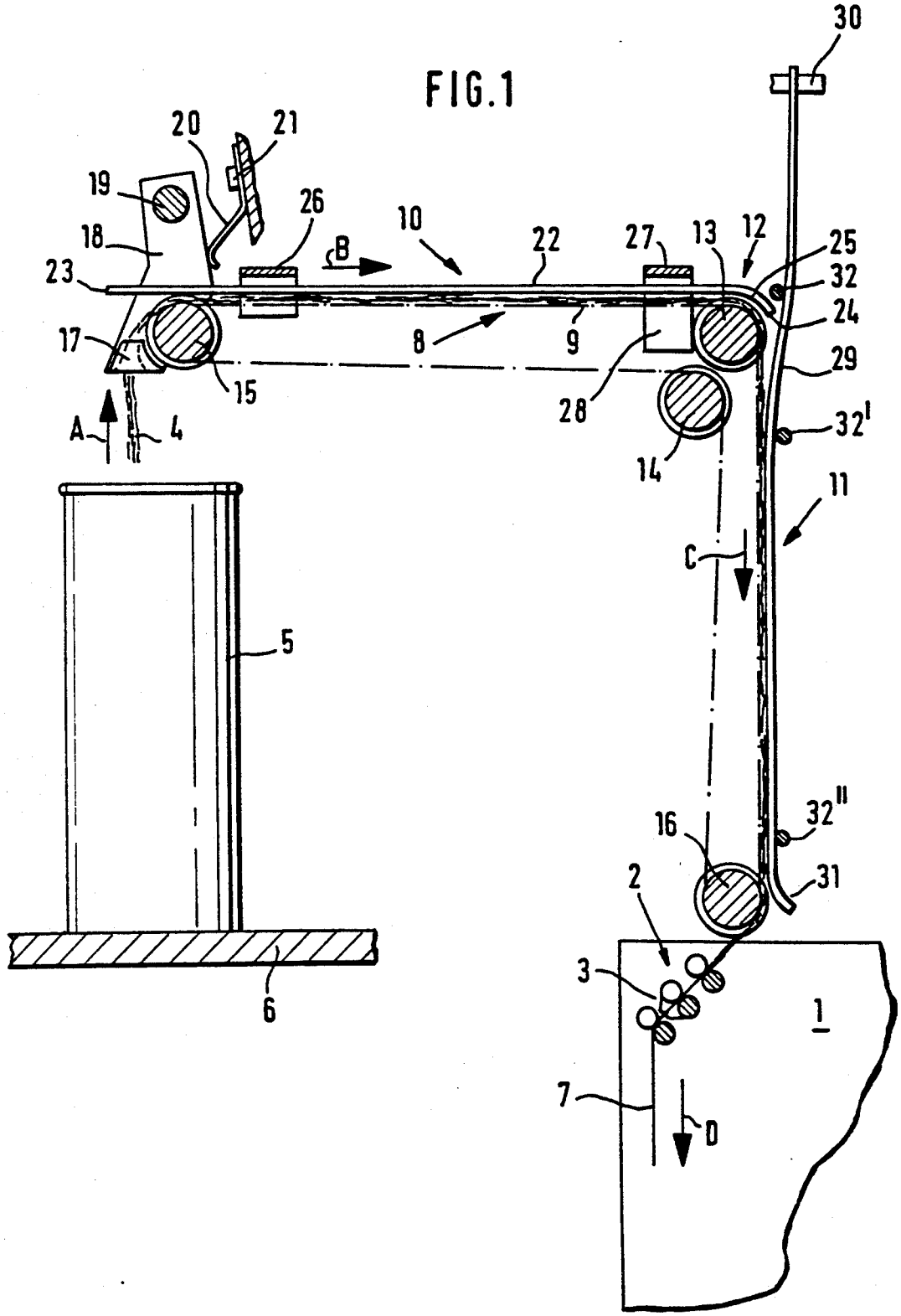
FIG. 1 is a schematic representation of a partial cross-sectional view of a spinning machine constructed according to a preferred embodiment of the invention.

A spinning machine 1, which is only outlined in FIG. 1 and which preferably is a ring spinning machine, has a plurality of spinning stations 2, preferably on both sides of the machine. Of these spinning stations 2, only one drafting unit 3 is shown which is constructed as a three-cylinder drafting unit. One sliver 4 respectively is fed to the individual drafting units 3 and is withdrawn from one can 5 respectively. Above the spinning machine 1, the cans 5 stand in an elevated manner on depositing sites of a platform 6. In a manner not shown in detail, the cans 5 are deposited in several rows extending in the longitudinal direction of the machine because the diameter of the cans 5 is larger than the spindle gauge of the spinning machine 1.

Relatively fine slivers 4 are processed, that is, finer slivers than had been customary. These slivers 4 have a size of from approximately Nm 0.3 to approximately Nm 0.8 and preferably a size in the range of approximately Nm 0.5 to Nm 0.7. Because of this size, it is possible to draft the slivers 4 in the three-cylinder drafting units 3 to a sliver 7 or a roving which is very fine, the rotational speeds of the feeding roller pair of the drafting units 3 being sufficiently high in order to ensure perfect concentricity.

In order to ensure that the fine slivers 4 do not suffer any unintentional drafting during their transport to the spinning passages, a transport device 8 is provided which withdraws the slivers 4, first in the direction of the arrow (A) upwards, then guides the slivers in the direction of the arrow (B) approximately horizontally to approximately the machine center, and from there, in the direction of the arrow (C) downward to the drafting units 3. The drafted yarns 7 leave the drafting unit 3 in the direction of the arrow (D) and then travel to a twisting element which is not shown. This twisting element is preferably a ring spindle However, it is also contemplated to provide a wind-around spindle and an air nozzle, or the like, as a twisting element according to other contemplated embodiments.

The transport device 8 comprises a plurality of conveyor belts 9 which form a horizontal conveying section 10 and a vertical conveying section 11. The conveyor belts 9 are constructed to be so wide that they can each receive two slivers 4 disposed side by side, as will be illustrated later by means of FIGS. 2, 3 and 7. These slivers 4 are fed to two adjacent drafting units 3, that is, drafting units 3 which, in a known manner, are equipped with common pressure roller twins as the top rollers. The cans 5, from which the two slivers 4 are withdrawn, stand side by side, being arranged in a joint row or in two adjacent rows. The conveyor belts 9 start approximately in the center between the two cans 5.

The conveyor belts 9 are guided by means of the deflecting rollers 13, 15, 16 in such a manner that they have the angular course with the horizontal section 10 and the vertical section 11. A fourth deflecting roller 14 is arranged to be slightly offset below the deflecting roller 13 so that also the returning end of the conveyor belts 9 follows this angular course. The deflecting roller 15 arranged closely above the cans 5 is held by means of a tensioning holder 18 which can be swivelled about a shaft 19 extending in the longitudinal direction of the machine and which is loaded in such a manner by means of a leaf spring 20 supported on a stationary holding device 21 that the respective conveyor belt 9 is tensioned. The tensioning holder 18 is provided with feeding hoppers 17 for the slivers 4, that is, preferably with two feeding hoppers 17 respectively. For purposes of clarification, it should be pointed out that, in the case of a machine used in practice, the respective adjacent conveyor belts 9 have horizontal sections 10 of a different length which, in each case, are assigned to the respective rows of cans in such a manner that the conveyor belts 9 start in the center above two rows of cans.

A sliding skid 22 is assigned to each conveyor belt 9 and rests with its own weight on the slivers 4 and thus presses the slivers 4 with a slight contact pressure against the conveyor belts 9. The sliding skid 22, which is preferably made of sheet metal, has a smooth underside which has a coefficient of friction with respect to the slivers 4 which is clearly lower than the coefficient of friction of the conveyor belts. The sliding surfaces of the sliding skids 22 may possibly be provided with a coating. However, as a rule, the surface quality of a rustproof sheet metal will be sufficient.

With their front end 23, the sliding skids 22 project beyond the deflecting rollers 15 so that a wedge-shaped feeding area for the slivers 4 is formed. The end of the sliding skids 22, which is in the rear or downstream in the transport direction, forms a deflecting guide 12 by means of which the slivers 4 are deflected downward in the area of the deflecting roller 13 toward the vertical section 11 of the conveyor belts 9. In the embodiment according to FIG. 1, the deflecting device 12 is formed by a bent end area 25 of the sliding skids 22, the bend of which is adapted to the circumference of the deflecting roller 13. The end 24 of the sliding skids 22 therefore reaches around a partial area of the circumference of the deflecting roller 13.

The sliding skids 22 are equipped with guiding elements 26, 27 by means of which the sliding skids 22 are laterally guided on the conveyor belts 9.

Figure 2:
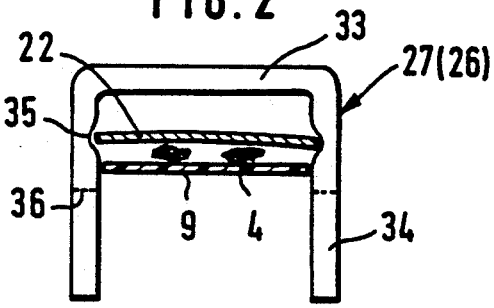
FIG. 2 is a cross-sectional view of the area of a conveyor belt and of a sliding skid of the spinning machine of FIG. 1.

As shown in FIG. 2, the guiding elements 26, 27 are constructed as U-shaped clamping elements which are mounted on the sliding skid 22 in the manner of riders. The legs 34, which project away from the cross web 33, are provided with indentations 35 at a distance to the cross web 33, in the area of which the sliding skid 22 is clamped in between the legs 34. The guiding elements 26, 27 are made of an elastic plastic material. As illustrated in FIG. 2, the legs 34 have a spacing which is slightly larger than the width of the conveyor belts 9. As outlined in FIG. 2 by means of line 36, the guiding elements 26 assigned to the forward end 23 of the sliding skids 22 are provided with shorter legs than the guiding elements 27 assigned to the area of the rearward end 24. The longer legs 34 of the guiding elements 27, which have the number 28 in FIG. 1, form stops by means of which the sliding skids 22 are positioned in their longitudinal direction on the conveyor belts 9. By means of the moving conveyor belts 9, the sliding skids 22 are taken along so far in the transport direction (arrow B) until the stops 28 strike against the deflecting roller 13. As a result, it is possible for the deflecting guide 12, that is, the bent end area 25, to be positioned precisely with respect to the circumference of the deflecting roller 13. In this case, it is expedient to mount the guiding elements 27 in the longitudinal direction of the sliding skids 22 adjustably on the sliding skids, for example, by means of detent grooves permitting an adaptation of the deflecting guide 12 to different sliver thicknesses.

The sliding skids 22 rest only loosely on the conveyor belts 9 or the slivers 4 so that they can easily be removed by an operator, which is advantageous for an inserting of the slivers 4 when the spinning machine 1 is started or during a batch change.

Sliding skids 29 are also assigned to the vertical section 11 of the conveyor belts 9. These sliding skids 29 consist of thin spring steel plates which are hung in a holding device 30 above the center of the machine. By means of rods 32, 32', 32" extending through in the longitudinal direction of the machine, they are guided such that they rest by means of a slight contact pressure force against the vertical section 11 of the conveyor belts 9. Under certain circumstances, it is possible to do without these vertical sliding skids 29. This applies particularly when the sliding skids 22 press the slivers 4 onto the conveyor belts 9 in such a manner that these are held on the surface of the conveyor belts 9 by a slight adhesive force. This may be supported by the fact that the conveyor belts 9 are developed to be rough on their conveying top side or are provided with a profiling, such as a perforation. It should also be mentioned that the deflecting rollers 13, 15, 16 and also the deflecting roller 14 are provided with ring collars so that the conveyor belts 9 are laterally guided.

Figure 3:
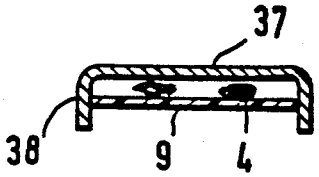
FIG. 3 is a cross-sectional view similar to FIG. 2 of a modified embodiment of a sliding skid.

As shown in FIG. 3, sliding skids 37 are provided in a modified embodiment which have a U-shaped cross-section and, by means of their legs 38, laterally frame the conveyor belts 9. In this case, additional guiding elements 26, 27 are not required. However, it must be ensured that the sliding skids 37 are securely guided in the transport direction with respect to their deflecting guide.

Figure 4:
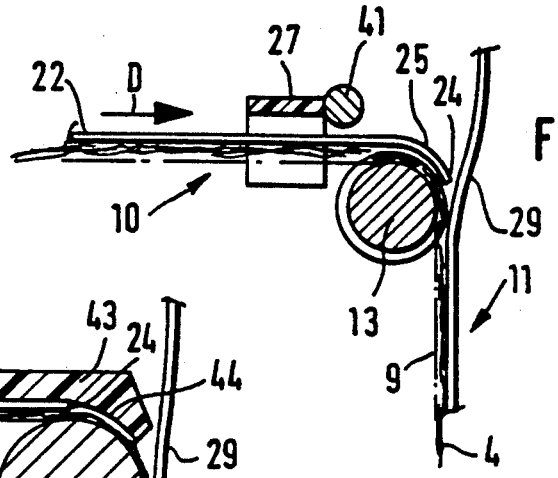
FIG. 4 is a sectional schematic view of the spinning machine of FIG. 1 in the area of a deflecting guide between a horizontal section and a vertical section of a conveyor belt.

In the embodiment according to FIG. 4, it is provided that the guiding element 27 of the sliding skid 22 is not supported on the deflecting roller 13 but on a preferably adjustable stop 41 which is arranged above the sliding skid 22.

Figure 5:
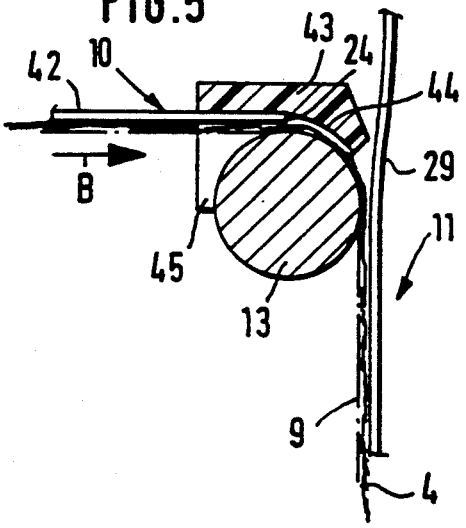
FIG. 5 is a sectional schematic view similar to FIG. 4 showing a modified embodiment.

In the embodiment according to FIG. 5, it is provided that the sliding skid 42 assigned to the horizontal section 10 is provided with a deflecting guide 43 which is constructed as a separate component, preferably of a plastic material. This deflecting guiding element 43 is a molding which has a bent interior surface which faces the deflecting roller 13 and deflects the slivers 4 to the vertical section 11. In this case, the bend 44 may be provided with lateral boundary webs so that it serves as a type of condenser for the slivers 4. The deflecting guiding element 43 is equipped with lateral legs 45, which reach around the pertaining conveyor belt 9 and place themselves against the deflecting roller 13 and thus determine the positioning of the sliding skid 42 and of the deflecting guiding element 43. The deflecting guiding element 43 is fixedly connected, for example, by means of a clip-on connection or by means of gluing or the like, with the sliding skid 42. In another embodiment, which is modified in comparison to the representation according to FIG. 5, it is provided that the deflecting guiding element 34 is provided with exchangeable inserts which form the area of the bend 44 and, by means of the exchange of which, an exchange of slivers of different thickness may take place. Such inserts may also be constructed as condensers, that is, they may be provided with lateral webs which converge in the transport direction.

Figure 6:
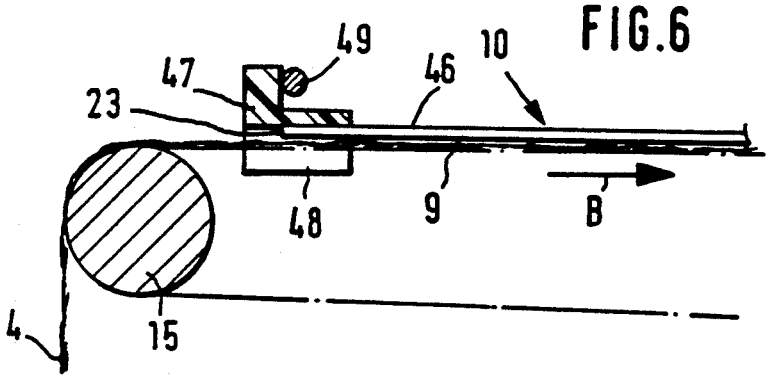
FIG. 6 is a sectional schematic view of the spinning machine of FIG. 1 in the feeding area of the slivers to a horizontal section of a conveyor belt and of a sliding skid disposed on it.

In the embodiment according to FIG. 6, it is provided that the sliding skid 46 shown there is provided with a rider-type guiding element 47 which, by means of its legs 48, reaches around the conveyor belt 9 in the area of the forward deflecting roller 15. An adjustable stop 49 is assigned to this guiding element 47 against which it strikes in the conveying direction (B) of the conveyor belt 9 and thus positions the sliding skid 46 with the deflecting guide which is not shown.

Figure 7:
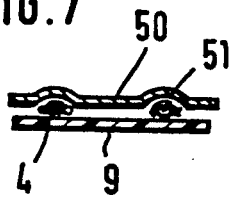
FIG. 7 is a cross-sectional view of another embodiment of a sliding skid which is provided with guiding grooves for two slivers guided next to one another.

In FIG. 7, a sliding skid 50 is shown which is provided with two longitudinal grooves 51 which extend at a distance from one another and are used for the lateral guiding of the slivers 4. The sliding skids 22, 37, 42, 46 of the already described embodiments may also be provided with such longitudinal grooves 51.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine having a plurality of spinning stations to which depositing sites are assigned for cans containing sliver to be spun, the spinning machine comprising:

conveyor belts which convey slivers from the cans to the spinning stations, each conveyor belt having two sections which are connected to one another at an angle;

a deflecting roller between the two sections of the conveyor belts, with one of the sections being situated in front of the deflecting roller;

sliding skids which cover the sections of the conveyor belts situated in front of the deflecting rollers, the sliding skids loosely contacting and pressing the slivers against the conveyor belts;

a deflecting guide on an end of each of the skids, the deflecting guide providing a transition between the two sections of the conveyor belt, a contour of the deflecting guide having a bending radius conforming with the diameter of the deflecting roller; and stops that position the sliding skids in the travelling direction of the conveyor belts.

2. A spinning machine according to claim 1, wherein one of the sections is an essentially horizontal belt section and the sliding skid which covers the essentially horizontal belt section is guided in the transverse direction on a conveyor belt forming the horizontal belt section.

3. A spinning machine according to claim 2, wherein the sliding skid is provided with guiding grooves extending in its longitudinal direction for guiding at least one of the slivers.

4. A spinning machine according to claim 2, wherein the sliding skid assigned to the essentially horizontal section of a conveyor belt forming the horizontal belt section is provided with at least one U-shaped guiding element, the legs of which reach around the pertaining conveyor belt, and wherein the sliding skid is provided with guiding grooves extending in its longitudinal direction for guiding at least one of the slivers.

5. A spinning machine according to claim 2, further comprising an introducing element that introduces the slivers between the section of the conveyor belt situated in front of the deflecting roller and the pertaining sliding skid.

6. A spinning machine according to claim 1, wherein the sliding skid is provided with at least U-shaped guiding element, the legs of which reach around the pertaining conveyor belts.

7. A spinning machine according to claim 6, wherein a stop is assigned at least to one of the guiding elements respectively.

8. A spinning machine according to claim 1, wherein the sliding skids are provided with guiding grooves extending in its longitudinal direction for guiding at least one of the slivers.

9. A spinning machine according to claim 1, further comprising an introducing element that introduces the slivers between the section of the conveyor belt situated in front of the deflecting roller and the pertaining sliding skid.

10. A spinning machine according to claim 9, wherein the introducing element is mounted on a tensioning holder for the deflecting roller.

11. A spinning machine according to claim 1, wherein said belt sections are formed by a single endless conveyor belt.

12. A spinning machine according to claim 1, wherein one of the belt sections is an essentially horizontal belt section and another of the belt sections is an essentially vertical belt section, and wherein said horizontal belt section extends from a position vertically above a sliver supply can from which the sliver is supplied to a position vertically above a spinning unit, said vertical belt section leading from the horizontal belt section downwardly to the spinning unit.

* * * * *